US009517470B2

(12) United States Patent
Seiler et al.

(10) Patent No.: US 9,517,470 B2
(45) Date of Patent: Dec. 13, 2016

(54) AGITATOR BALL MILL HAVING WEAR PREVENTION

(75) Inventors: Andreas Seiler, Tauberbischofsheim (DE); Klaus Ahke, Wertheim (DE)

(73) Assignee: Maschinenfabrik Gustav Eirich GmbH & Co., KG, Hardheim (DE)

( * ) Notice: Subject to any disclaimer, the term of this patent is extended or adjusted under 35 U.S.C. 154(b) by 362 days.

(21) Appl. No.: 14/122,304

(22) PCT Filed: Jun. 4, 2012

(86) PCT No.: PCT/EP2012/060523

§ 371 (c)(1),
(2), (4) Date: Nov. 26, 2013

(87) PCT Pub. No.: WO2012/171825

PCT Pub. Date: Dec. 20, 2012

(65) Prior Publication Data

US 2014/0097281 A1 Apr. 10, 2014

(30) Foreign Application Priority Data

Jun. 14, 2011 (DE) ..... 10 2011 051 041

(51) Int. Cl.
*B02C 17/22* (2006.01)

(52) U.S. Cl.
CPC ..... *B02C 17/22* (2013.01)

(58) Field of Classification Search
CPC ..... B02C 17/22; B02C 17/225
USPC ..... 241/176, 172, 182, 183
See application file for complete search history.

(56) References Cited

U.S. PATENT DOCUMENTS

| | | | | |
|---|---|---|---|---|
| 5,630,558 | A | 5/1997 | Nitta | |
| 2002/0033425 | A1 * | 3/2002 | Sellars | B02C 17/22 241/182 |

FOREIGN PATENT DOCUMENTS

| | | |
|---|---|---|
| AT | 003 170 U1 | 10/1999 |
| DE | 40 39 257 A1 | 6/1992 |
| DE | 100 47 095 A1 | 4/2002 |

* cited by examiner

*Primary Examiner* — Mark Rosenbaum
(74) *Attorney, Agent, or Firm* — Paul & Paul

(57) ABSTRACT

The invention relates to an agitator ball mill having a vertically arranged container, in which there an agitator that can be rotated about a vertical axis is arranged, and having at least one wear prevention element that can be fitted to the container inner wall with the aid of a fixing system, wherein the fixing system comprises a fixing pin and a fixing cut-out, which are arranged on the container inner wall and/or the rear side of the wear prevention element in such a way that the wear prevention element can be fixed to the container inner wall by means of a movement of the wear prevention element in a direction which forms an angle $\alpha>0°$ with the vertical axis of the rotatable agitator, in that the fixing pin is guided into the fixing cut-out.

15 Claims, 7 Drawing Sheets

AGITATOR BALL MILL HAVING WEAR PREVENTION

Figure 1:
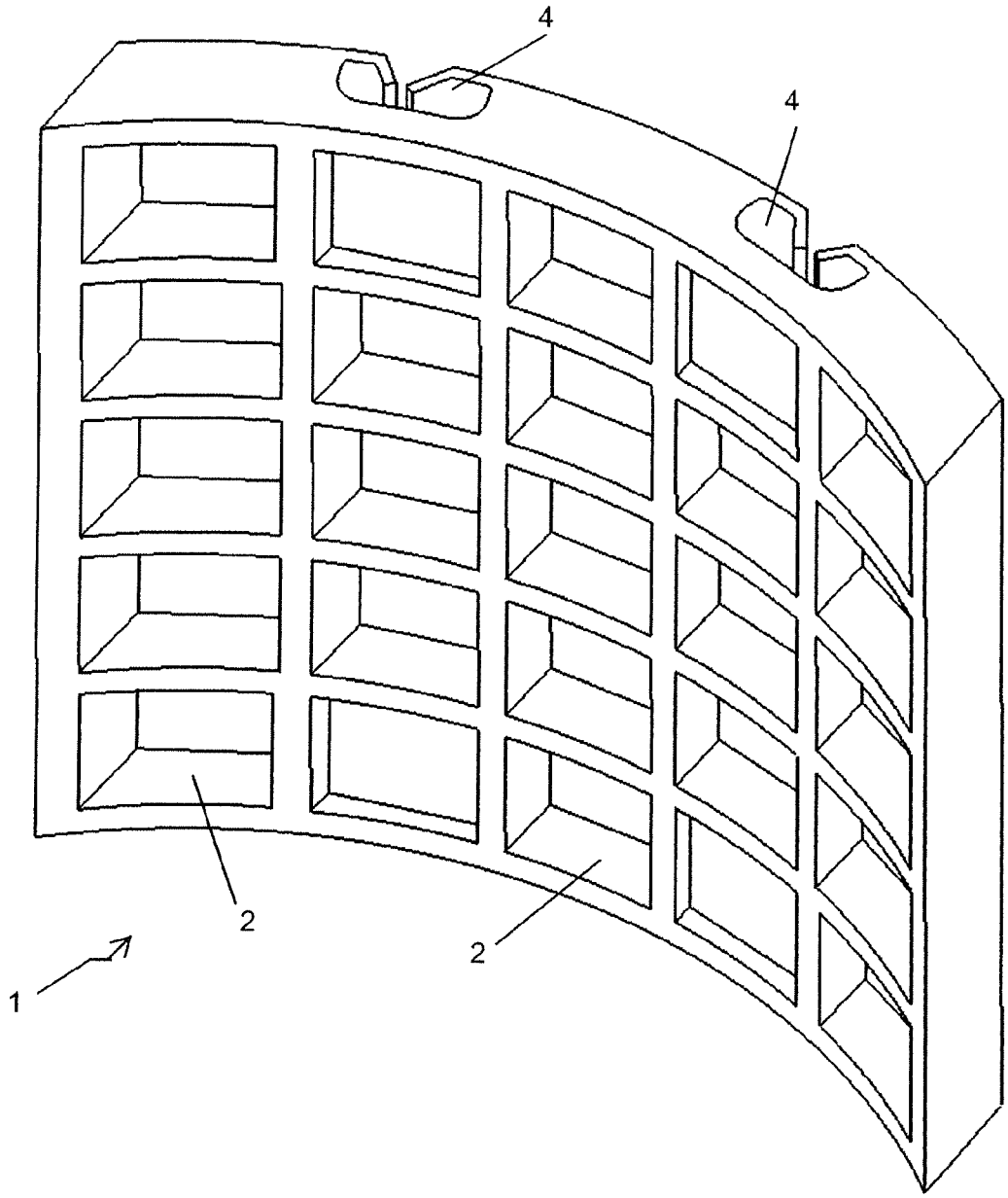

The present invention concerns an agitator ball mill having a vertically arranged container in which there is arranged an agitator which is rotatable about a vertical axis. Such an agitator ball mill is filled with grinding bodies comprising for example steel or wear-resistant ceramic materials. The agitator leads to a movement of the grinding bodies in the container. The grinding material to be processed is continuously passed through the container so that the grinding material is comminuted by impact and shearing forces between the grinding bodies.

The grinding bodies used result in wear of the generally cylindrical container. It is therefore already known for the container inside wall to be equipped with wear prevention elements which if required can be replaced or which in turn can carry suitable replaceable prevention elements. As a result it is only the prevention elements but not the container that is worn.

Thus for example U.S. Pat. No. 5,630,558 discloses an agitator ball mill of the specified kind, to the container inside wall of which is mounted a shelf-like wear prevention element. That element has a multiplicity of shelf compartments which are frequently also referred to as cassettes. In operation of the agitator ball mill, grinding bodies are accommodated in those shelf compartments, which grinding bodies no longer take part in the grinding operation and therefore protect the container inside wall from wear. The shelf or cassette structure has the result that the grinding bodies accommodated therein do not move in operation so that there is no relative speed between the wall and the grinding bodies and the container inside wall is protected.

Such wear prevention elements are generally made from steel and are therefore susceptible to corrosion. Structures of high-quality steel have already been proposed, but these cause an extreme increase in the cost of wear prevention.

The wearing walls are of very great weight, in particular when the grinding bodies have become fixed in the shelf compartments or cassettes, and that markedly increases the difficulties involved in replacement. It has therefore already been proposed in U.S. Pat. No. 5,630,558 that the shelf structure is to be composed of individual modules which are screwed together. Nonetheless replacement of the wear prevention element requires a very great deal of time as the screw means are frequently severely corroded and have to be separated by grinding. It is therefore not unusual if replacement of the wear prevention arrangement of an agitator ball mill which can perfectly well be several meters in height requires two complete days, during which the agitator ball mill cannot be used.

As an alternative therefore an agitator ball mill is already known in which the container inside wall is magnetic, whereby the ferromagnetic grinding bodies are held fast to the inside wall by the magnetic forces. As the magnetic forces are not excessively great, the wall spacing relative to the agitator must be selected to be greater in order to ensure that there is no relative speed between wall and grinding bodies. The magnetic inside wall is to be protected from corrosion. Rubber coatings are frequently used for that purpose, which however in turn reduce the magnetic forces. Such a structure is relatively costly and presupposes the use of ferromagnetic grinding bodies, which is not wanted for all applications.

Taking the described state of the art as the basic starting point therefore the object of the present invention is to provide an agitator ball mill having a wear prevention system which is inexpensive, simple to replace and is of the lowest possible weight with a high level of resistance to wear and a very high level of resistance to corrosion.

That object is attained by an agitator ball mill of the kind set forth in the opening part of this specification, having at least one wear prevention element which can be mounted to the container inside wall by means of a fixing system, wherein the fixing system comprises a fixing pin and a fixing opening which are arranged on the container inside wall and/or the rear side of the wear prevention element in such a way that the wear prevention element can be fixed to the container wall by a movement of the wear prevention element in a direction which includes an angle $\alpha>0°$ with the vertical axis of the rotatable agitator, by the fixing pin being guided into the fixing opening.

More specifically it has been found that in the case of vertical agitator ball mills the forces applied to the wear prevention element by the grinding bodies during the grinding operation act substantially in the direction of the container wall. In other words the wear prevention element is pressed in operation against the container wall so that there is no need for a fixing device for carrying high forces.

The wear prevention element therefore has to be moved away from the container wall to be released from the wall. As however the grinding bodies exert a force on the wear prevention element in the direction of the container wall in the grinding operation, the arrangement according to the invention ensures that the wear prevention element cannot be released from the container wall in operation. Fixing of the wear prevention element to the wall can be effected without a tool, by the design configuration according to the invention.

It is therefore in accordance with the invention if the wear prevention element has at its rear side a corresponding fixing opening and the wear prevention element can simply be hung on the fixing pin fixed to the container. If the wear prevention element has the fixing pin it can be urged into the corresponding fixing opening arranged in or on the container. The wear prevention element can thus be fixed to the wall or removed therefrom again, without a tool. In contrast to the structures in the state of the art the wear prevention element or elements is or are only hung in the fixing pins. The angle $\alpha$ is preferably more than 45° and is best about 90°.

The term fixing opening is used to denote any element which can receive and hold the fixing pin. The fixing opening therefore does not necessarily need to be arranged within a surface, for example the rear side of the wear prevention element, but can also be arranged in the form of a pipe clip-like element at the rear side of the wear prevention element or on the container inside wall.

In a preferred embodiment the fixing opening or fixing pin have an elastic element which is of such a configuration that the thickness of the fixing pin is greater than the width of the fixing opening so that the fixing pin can be removed from the fixing opening only by the application of a release force greater than the return force of the elastic element. In other words the elastic element must be elastically deformed upon fixing and upon release.

Thus for example the elastic element can be arranged at the fixing opening and can at least partially close same.

In order therefore to release the wear prevention element from the container wall the fixing pin has to be pulled out of the fixing opening and in that case the elastic element has to be displaced out of its rest position. It is accordingly necessary to overcome the return force of the elastic element. Equally, when introducing the fixing pin into the fixing opening, the elastic element also has to be moved out of its rest position.

An alternative embodiment provides that the angle $\alpha<90°$ and the direction of movement includes an angle $\beta>90°$ with the direction of the force due to the weight of the wear prevention element. The result of this is that the wear prevention element has to be lifted a little to release it. That prevents unwanted detachment of the wear prevention element from the container wall, for example when opening the container.

In principle however it would also be possible for the wear prevention element to have to be moved to the side a little for release and fixing purposes.

In a further preferred embodiment the wear prevention element and the container inside wall have latching means, by means of which the wear prevention element can be latched to the container inside wall.

In a further preferred embodiment the container inside wall has a plurality of bar-like projections, the bar-like projections having at least one fixing pin. In that case the bar-like projections preferably extend vertically or horizontally and best vertically and horizontally. By virtue of the bar-like projections, it is possible for the fixing pin to be oriented in its longitudinal orientation in parallel relationship with the container inside wall.

Particularly preferably the bar-like projections are of a height which is less than the thickness of the wear prevention element, wherein preferably the bar-like projections are so arranged that the wear prevention element is in contact with a bar-like projection in the fixed position, that is to say when the fixing pin is arranged in the fixing opening.

That configuration provides that the bar-like projections afford an abutment surface for the wear prevention element, and this prevents a relative movement of the wear prevention element relative to the container inside wall.

The elastic element is best of such a configuration that the force necessary to fix the wear prevention element to the container wall is less than the force needed to release the wear prevention element from the container wall.

Preferably the elastic element has at least one or best two tongue elements extending from the edge of the fixing opening over a part of the opening, wherein the tongue element is angled relative to the rear side of the wear prevention element in the direction of the fixing opening or has a correspondingly angled portion. That arrangement provides that the fixing pin can be pressed into the fixing opening with a comparatively slight force. The reversed movement however requires a greater force as the tongue element now has to be deflected much more out of its rest position.

In a further preferred embodiment the at least one tongue element, the fixing opening and the fixing pin are so dimensioned that in the position in which the fixing pin is received in the fixing opening the fixing pin is in contact both with the bottom surface of the fixing opening and also with the end face of the at least one tongue element.

Alternatively elastic ramp means could also be envisaged, the ramp angle of which is less in the fixing direction than in the release direction.

In a further preferred embodiment the wear prevention element substantially comprises plastic or rubber. In principle it can also consist entirely of plastic or rubber, but metallic reinforcing elements can be advantageous.

In a further preferred embodiment the wear prevention element has a plurality of open chambers or cassettes for receiving grinding bodies.

Figure 2:
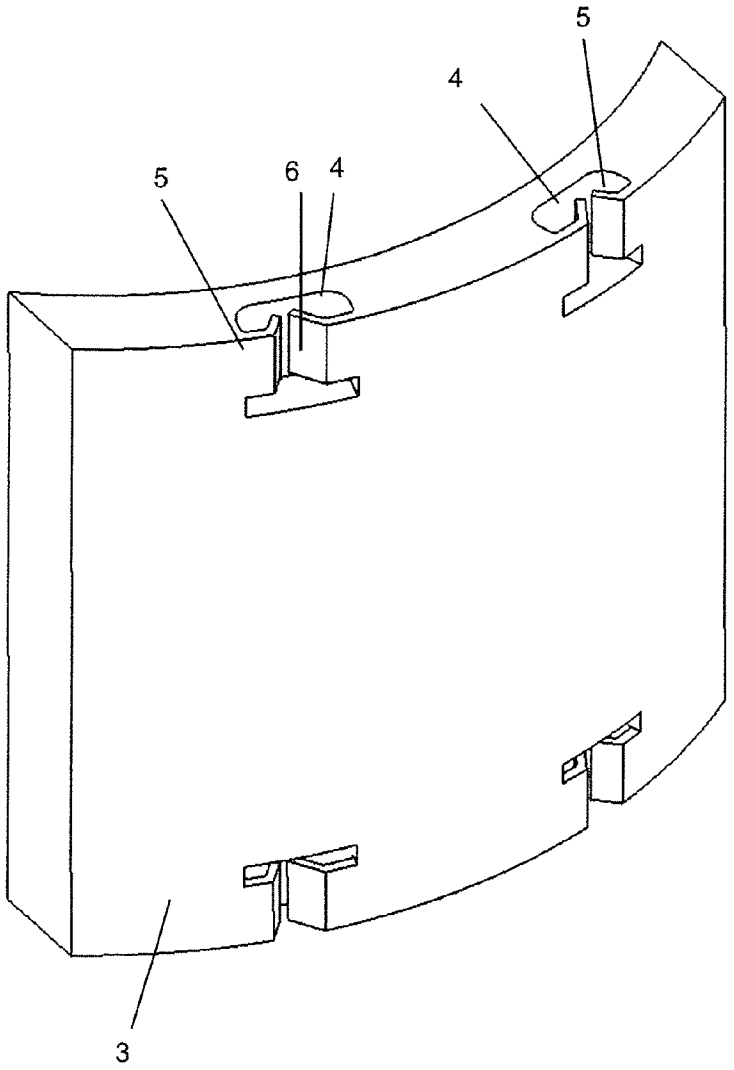
Figure 3:
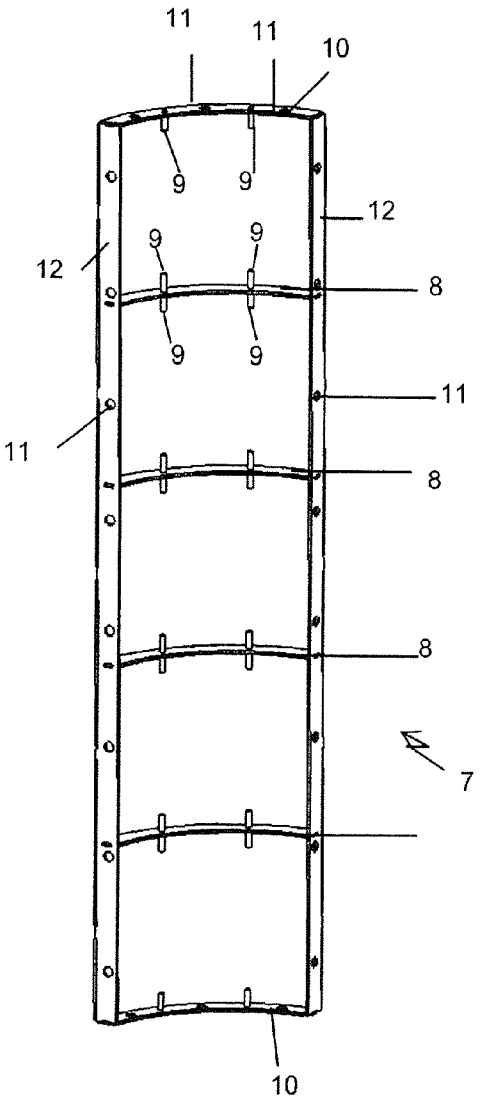
Figure 4:
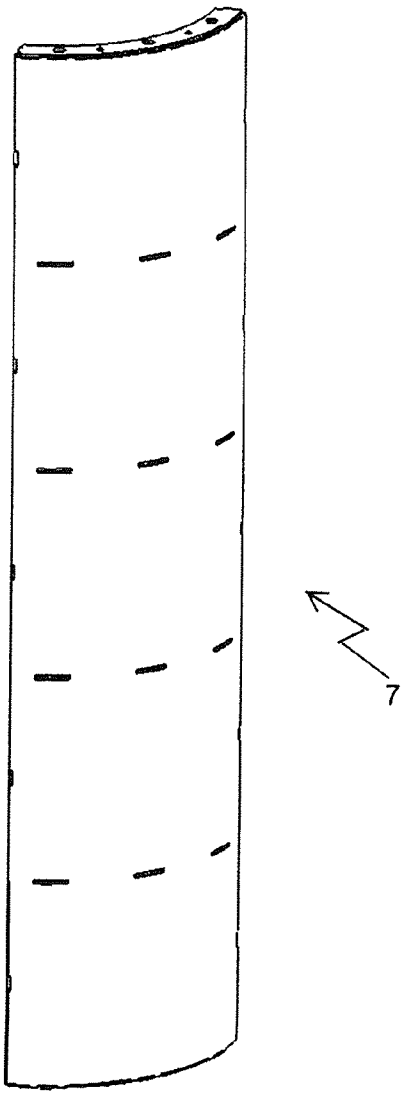
Figure 5:
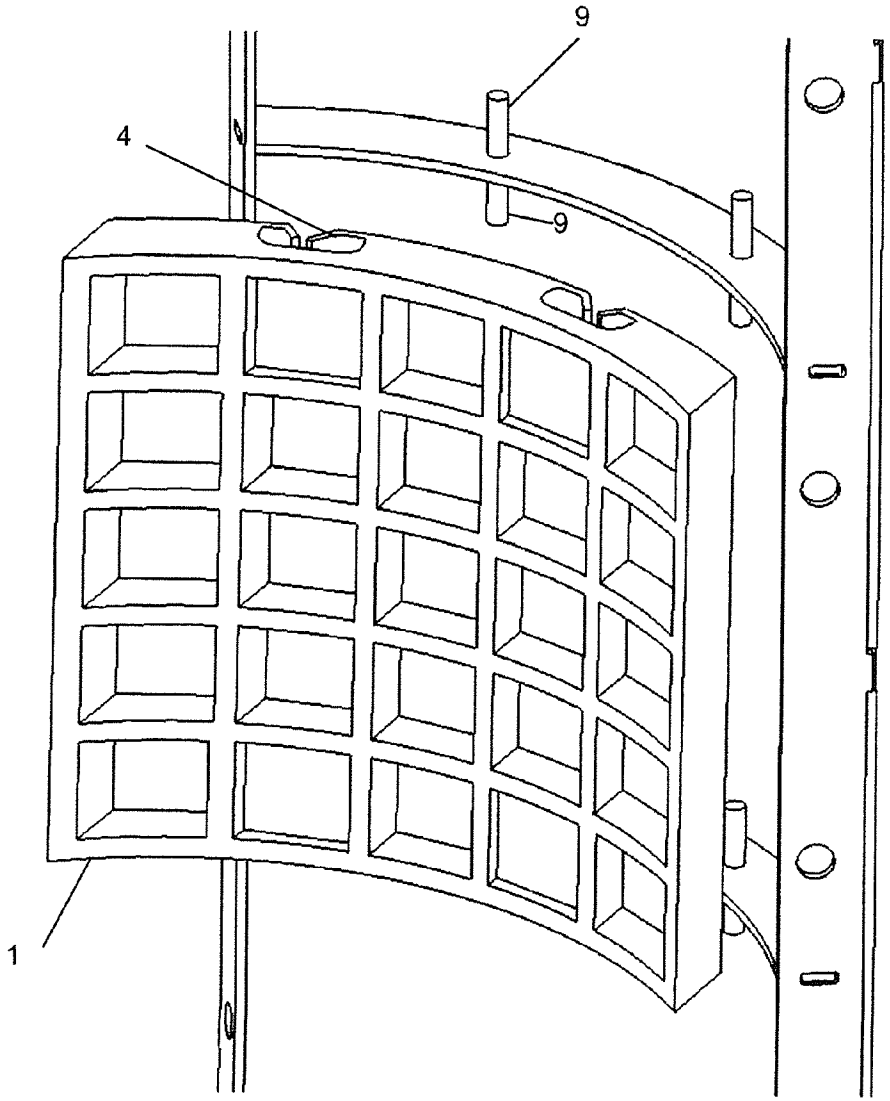
Figure 6:
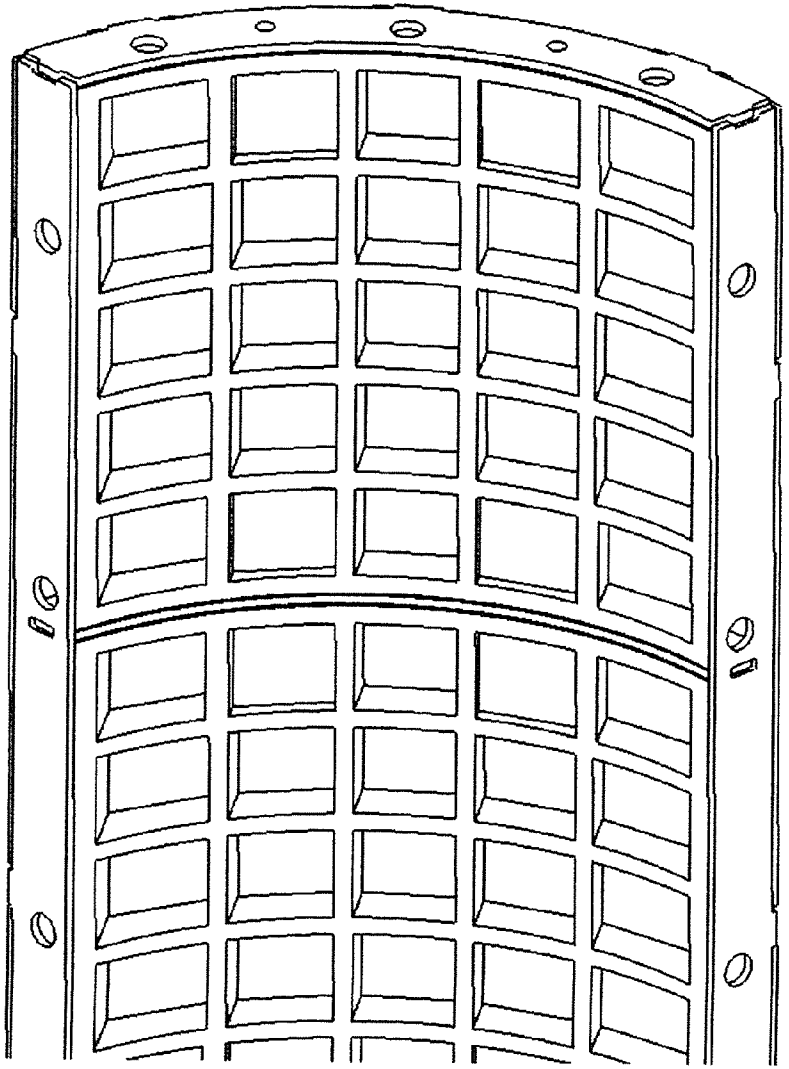
Figure 7:
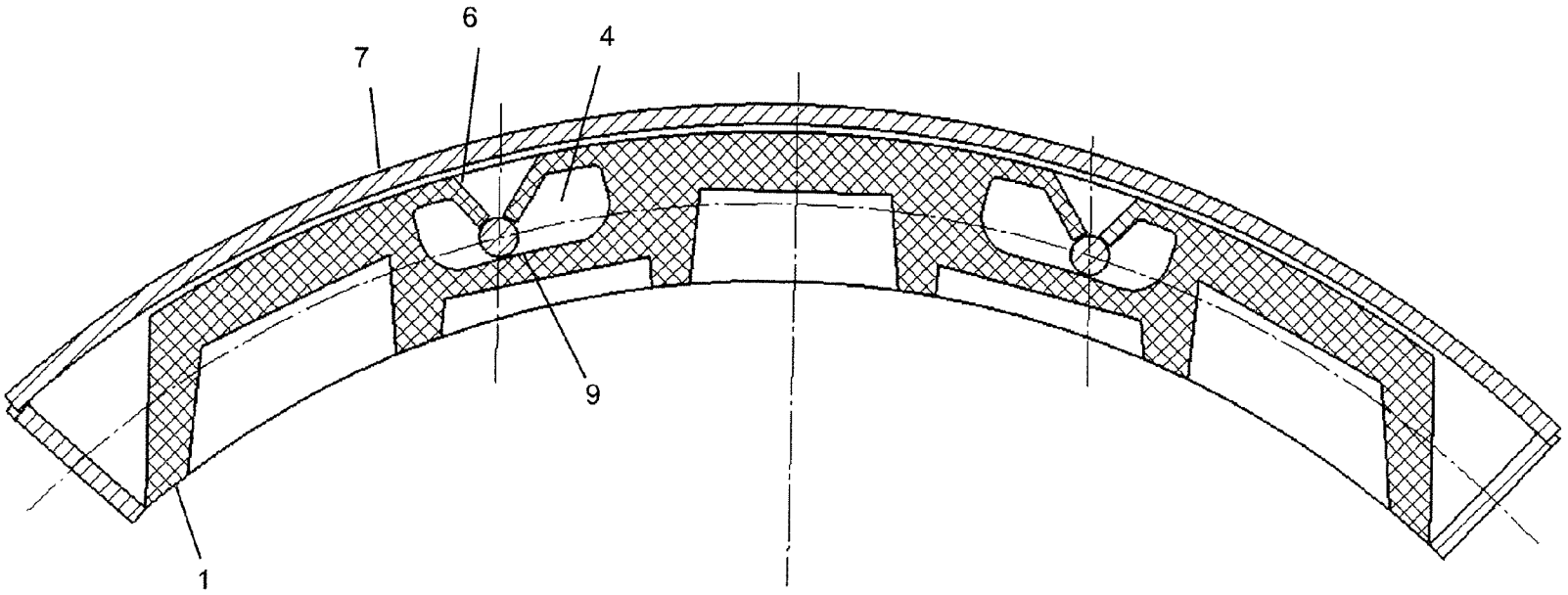

Further advantages, features and possible uses will be clearly apparent from the description hereinafter of a preferred embodiment of the invention. In the drawing:

FIG. 1 shows a perspective view from the front of a wear prevention element according to the invention, FIG. 2 shows a perspective view of the FIG. 1 element from the rear, FIG. 3 shows a view from the front of the holding structure of the wear prevention element, FIG. 4 shows a view from the rear of the structure shown in FIG. 3, FIG. 5 shows a view of the wear prevention element directly before insertion into the holding structure, FIG. 6 shows the holding structure with inserted wear prevention element, and FIG. 7 shows a sectional view through the fixing system according to the invention.

FIG. 1 shows a wear prevention element 1. The wear prevention element 1 is made from plastic material. It has a front side in which a plurality of chambers 2 are provided. The wear prevention element 1 is of a curved configuration, wherein the curvature corresponds to the curvature of the container inside wall to which the wear prevention element is to be fixed.

FIG. 2 shows a view of the wear prevention element 1 from the rear. A total of four fixing openings 4 are arranged in the rear side 3 of the wear prevention element. Those fixing openings 4 are partially covered over by elastically deformable tongue elements 5, wherein the elastically deformable tongue elements 5 have a straight portion which substantially follows the surface of the rear side, and an angled portion 6 which is angled in the direction of the bottom of the fixing opening 4.

FIGS. 3 and 4 show the holding structure 7 which is fixed to the container inside wall. The holding structure 7 has a row of horizontally extending bar-like projections 8 in which fixing pins 9 extending in a vertical direction parallel to the container inside wall extend both upwardly and also downwardly. Arranged at the two ends of the holding structure 7 are bar-like projections 10 having fixing holes 11 with which the holding structure 7 can be fixed to the container. In addition there are also provided here fixing pins 9 which however extend only in one direction.

There are also vertically extending bar-like projections 12 also having fixing holes 11 with which the fixing structure 7 can be fixed to adjacent fixing structures.

FIG. 5 shows the wear prevention element of FIG. 1 before the fixing structure. It will be seen that the fixing pins 9 are so arranged that they can be placed in the fixing openings 4. The wear prevention elements 1 can thus be simply clicked into place on the carrier structure.

Such a clicked-in condition can be seen from FIG. 6.

FIG. 7 shows a sectional view illustrating the situation with the wear prevention element clicked into place in the fixing structure 7. The fixing pins 9 are arranged in the fixing opening 4 in this situation. The elastic element with its tongue portions 6 is so arranged that the end faces of the tongue element 6 are in contact with the fixing pin 9. It will be clearly seen that the wear prevention element 1 can be clicked into place in the holding structure 7 with relatively little force as the tongue portions 6 have to be moved only a little out of their rest position. As soon as the condition shown in FIG. 7 is reached however, that is to say as soon as the wear prevention element 1 has been clicked in place, it can be removed again only by the application of a greater release force, as now the tongue portions 6 have to be upset and curved outwardly.

The structure according to the invention is very light and can be clicked into place in the holding structure 7 and removed therefrom again by one person in a very short time. The usual stoppage times for replacement of the wear prevention elements can thus be drastically reduced.

LIST OF REFERENCES

1 wear prevention element
2 chambers
3 rear side
4 fixing openings
5 tongue elements
6 tongue portions
7 holding structure
8 bar-like projections
9 fixing pin
10 bar-like projections
11 fixing holes
12 bar-like projections

The invention claimed is:

1. An agitator ball mill having a vertically arranged container in which there is arranged an agitator which is rotatable about a vertical axis, and at least one wear prevention element which can be mounted to the container inside wall by means of a fixing system, wherein the fixing system consists of a fixing pin and a fixing opening which are arranged on the container inside wall and/or the rear side of the wear prevention element in such a way that the wear prevention element can be fixed to the container wall by a movement of the wear prevention element in a direction which includes an angle $\alpha>0°$ with the vertical axis of the rotatable agitator, by the fixing pin being guided into the fixing opening.

2. An agitator mill having a vertically arranged container in which there is arranged an agitator which is rotatable about a vertical axis, and at least one wear prevention element which can be mounted to the container inside wall by means of a fixing system, wherein the fixing system comprises a fixing pin and a fixing opening which are arranged on the container inside wall and/or the rear side of the wear prevention element in such a way that the wear prevention element can be fixed to the container wall by a movement of the wear prevention element in a direction which includes an angle $\alpha>0°$ with the vertical axis of the rotatable agitator, by the fixing pin being guided into the fixing opening, the agitator ball mill characterised in that there is provided an elastic element which is arranged at the fixing opening and at least partially closes same so that the fixing pin can be removed from the fixing opening only by the application of a release force greater than the return force of the elastic element.

3. An agitator ball mill according to claim 2 characterised in that the fixing pin is at least portion-wise elastic and is of a thickness which is greater than the width of the fixing opening so that the fixing pin can be removed from the fixing opening only by the application of a release force greater than the return force of the elastic portion of the fixing pin.

4. An agitator ball mill according to claim 2 characterised in that the angle $\alpha<90°$ and the direction of movement includes an angle $p>90°$ with the direction of the force due to gravity.

5. An agitator ball mill having a vertically arranged container in which there is arranged an agitator which is rotatable about a vertical axis, and at least one wear prevention element which can be mounted to the container inside wall by means of a fixing system, wherein the fixing system comprises a fixing pin and a fixing opening which are arranged on the container inside wall and/or the rear side of the wear prevention element in such a way that the wear prevention element can be fixed to the container wall by a movement of the wear prevention element in a direction which includes an angle $\alpha>0°$ with the vertical axis of the rotatable agitator, by the fixing pin being guided into the fixing opening wherein there is provided an elastic element which is arranged at the fixing opening and at least partially closes same so that the fixing pin can be removed from the fixing opening only by the application of a release force greater than the return force of the elastic element.

6. An agitator ball mill according to one of claims 2 or 5 characterised in that the container inside wall has a plurality of bar-like projections, wherein the bar-like projections have at least one fixing pin, wherein the bar-like projections extend horizontally.

7. An agitator ball mill according to claim 6 characterised in that the bar-like projections are of a height which is less than the thickness of the wear prevention element, wherein the bar-like projections are so arranged that the wear prevention element is in contact with a bar-like projection in the fixed position, that is to say when the fixing pin is arranged in the fixing opening.

8. An agitator ball mill according to one of claims 2 or 5 characterised in that the fixing pin is oriented parallel to the container inside wall and at best vertically.

9. An agitator ball mill according to one of claims 2 or 5 characterised in that the wear prevention element comprises plastic or rubber.

10. An agitator ball mill according to one of claims 2 or 5 characterised in that the wear prevention element has a plurality of open chambers for receiving grinding bodies.

11. An agitator ball mill having a wear prevention element for fixing to the container inside wall of the mill according to one of claims 2 or 5 characterised in that on its rear side the wear prevention element has a fixing opening which is of such a configuration that destruction-free release of the fixing pin from the fixing opening is possible only by the application of a release force.

12. An agitator ball mill having a vertically arranged container in which there is arranged an agitator which is rotatable about a vertical axis, and at least one wear prevention element which can be mounted to the container inside wall by means of a fixing system, wherein the fixing system comprises a fixing pin and a fixing opening which are arranged on the container inside wall and/or the rear side of the wear prevention element in such a way that the wear prevention element can be fixed to the container wall by a movement of the wear prevention element in a direction which includes an angle $\alpha>0°$ with the vertical axis of the rotatable agitator, by the fixing pin being guided into the fixing opening wherein there is provided an elastic element which is arranged at the fixing opening and at least partially closes same so that the fixing pin can be removed from the fixing opening only by the application of a release force greater than the return force of the elastic portion of the fixing pin.

13. An agitator ball mill according to claim 3 or claim 12 characterised in that the elastic element has at least one tongue element extending from the edge of the fixing opening over a part of the opening, wherein the tongue element is angled relative to the rear side of the wear prevention element in the direction of the fixing opening or has a correspondingly angled portion.

14. An agitator ball mill according to claim 13 characterised in that the at least one tongue element, the fixing opening and the fixing pin are so dimensioned that in the position in which the fixing pin is received in the fixing opening the fixing pin is in contact both with the bottom surface of the fixing opening and also with the end face of the at least one tongue element.

15. An agitator ball mill having a vertically arranged container in which there is arranged an agitator which is rotatable about a vertical axis, and at least one wear prevention element which can be mounted to the container inside wall by means of a fixing system, wherein the fixing system comprises a fixing pin and a fixing opening which are arranged on the container inside wall and/or the rear side of the wear prevention element in such a way that the wear prevention element can be fixed to the container wall by a movement of the wear prevention element in a direction which includes an angle $\alpha>0°$ with the vertical axis of the rotatable agitator, by the fixing pin being guided into the fixing opening wherein the angle $\alpha<90°$ and the direction of movement includes an angle $p>90°$ with the direction of the force due to gravity.

* * * * *